US005819938A

United States Patent [19]

Gabrio et al.

[11] Patent Number: 5,819,938

[45] Date of Patent: Oct. 13, 1998

[54] COIL CAP

[76] Inventors: William G. Gabrio; Andrew N. Barrett; Craig G. Dolsby, all of 410 E. Trent, Spokane, Wash. 99202

[21] Appl. No.: 950,149

[22] Filed: Oct. 14, 1997

[51] Int. Cl.[6] ..... B65D 85/66

[52] U.S. Cl. ..... 206/414; 206/413

[58] Field of Search ..... 206/389, 401, 206/398, 413, 415, 414, 416; 428/906

[56] References Cited

U.S. PATENT DOCUMENTS

| | | | |
|---|---|---|---|
| 1,491,063 | 4/1924 | Piper | 206/413 |
| 1,603,959 | 10/1926 | Leven | 206/413 |
| 1,989,182 | 1/1935 | Blake | 206/414 |
| 4,911,299 | 3/1990 | Peeters | 206/415 |
| 5,090,566 | 2/1992 | Yount | 206/416 |
| 5,133,171 | 7/1992 | Chase et al. | 206/414 |

*Primary Examiner*—David T. Fidei
*Attorney, Agent, or Firm*—David S. Thompson

[57] ABSTRACT

A coil cap cover for a cylindrical coil of aluminum stock provides a round fabric portion 20 sized to fit either end of the cylindrical coil of aluminum and a substantially rectangular attached fabric skirt portion 50 which covers an adjacent portion of the cylindrical sidewall of the coil. A welded region 70 connects a perimeter edge of the round fabric portion to an upper edge of the fabric skirt portion, creating a three-dimensional coil cap. An overlap weld 80 fastens the upper edges of the ends of the skirt portion together with a segment of the perimeter of the round fabric portion. A crimp weld 90 fastens a lower corner of each end of the skirt portion together.

2 Claims, 2 Drawing Sheets

COIL CAP

CROSS-REFERENCES

There are no applications related to this application filed in this or any foreign country.

BACKGROUND

Aluminum stock produced by aluminum manufacturers is often sold in cylindrical coils, typically having a diameter of 10" to 90". As a protective measure, the circular ends of such cylindrical coils are typically covered by a fabric coil cap. Coil caps typically provide a circular end piece having a perimeter attached to a rectangular skirt piece which wraps about an end portion of the cylindrical sidewalls of the aluminum coil. In providing such a coil cap, it is important to maximize the protective nature, particularly on the circular end surface, while also minimizing the overall cost.

Known coil caps are typically constructed of a fabric skirt portion that is made of a woven polyethylene fabric which is coated with polyethylene. In most applications, the round fabric is made of a single or double layer of a spun-bonded olefin fabric. In the construction of such known coil caps, the round fabric is then glued to the coated polyethylene skirt. Where double layers of round fabric are used, it is frequently the case that hot glue is applied to both sides of an upper edge of the skirt, which is then sandwiched between the two round layers. Glue is used because welding two such dissimilar fabrics together is not possible.

Coil caps constructed according to the above method are not easily recyclable. This is primarily because of the very dissimilar nature of the polyethylene skirt and the spun-bounded olefin round fabric. However, the glue used to bond these dissimilar fabrics together also tends to prevent convenient recycling.

What is needed is coil cap having a lighter-weight skirt, which can be more economically produced, combined with a heavier-weight round fabric portion, which can better protect the cylindrical aluminum coil. The round fabric and skirt fabric should be made of the same material to promote recyclability. The means of connection between the fabric should not require glue, which is an expense in the manufacturing process, and which prevents convenient recyclability.

SUMMARY

A preferred embodiment of the coil cap of the present invention provides:

(A) A heavier-weight round fabric portion is made of woven, coated polyethylene fabric. In a typical embodiment, the woven fabric is made of 1600 denier polyethylene tape, and is 12 mils thick, having a 1.75 mil polyethylene coating on each side.

(B) A lighter-weight rectangular fabric skirt portion is also made of woven, coated polyethylene fabric. In a typical embodiment, the woven fabric is 6 mils thick, having a coating of polyethylene of approximately 1 mil thick on each side.

(C) A welded region, joining the perimeter edge of the heavier-weight round fabric portion to the upper edge of the lighter-weight skirt fabric portion.

(D) A crimp weld secures a lower corner on each end of the rectangular fabric skirt portion.

It is therefore a primary advantage of the present invention to provide a novel coil cap having a heavier-weight round fabric portion welded to a lighter-weight fabric skirt portion, particularly where the use of hot glue is not possible with such fabrics. A related advantage is that while the fabrics used in the present invention cannot withstand hot glue, they are otherwise more durable that known fabrics adapted for use in coil cap construction, particularly in terms of abrasion and tearing resistance.

Another advantage of the present invention is to provide a novel coil cap having a welded region that is extremely durable, and which will not separate.

A still further advantage of the present invention is to provide a novel coil cap having a welded region that is three-dimensional in nature, and that allows some bunching, wrinkling or pleating of the upper edge of the fabric skirt portion within the welded region, while still providing a smooth, attractive and strong weld.

DRAWINGS

These and other features, aspects, and advantages of the present invention will become better understood with regard to the following description, appended claims, and accompanying drawings where:

Figure 1:
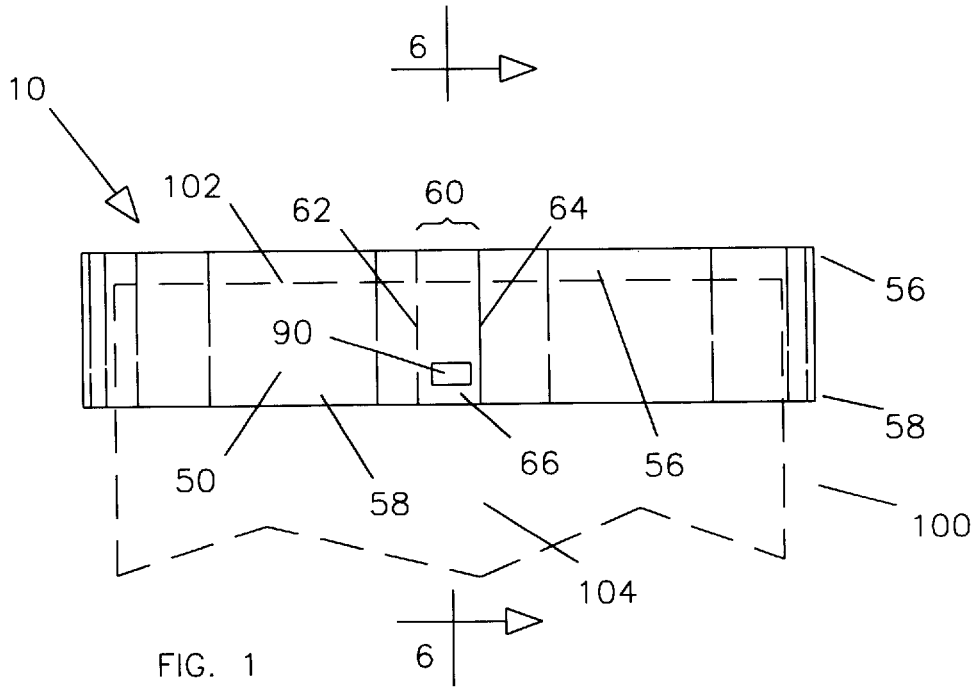
FIG. 1 is a side orthographic view of a version of the coil cap of the invention, showing an upper portion of the aluminum coil in dotted outline.
Figure 2:
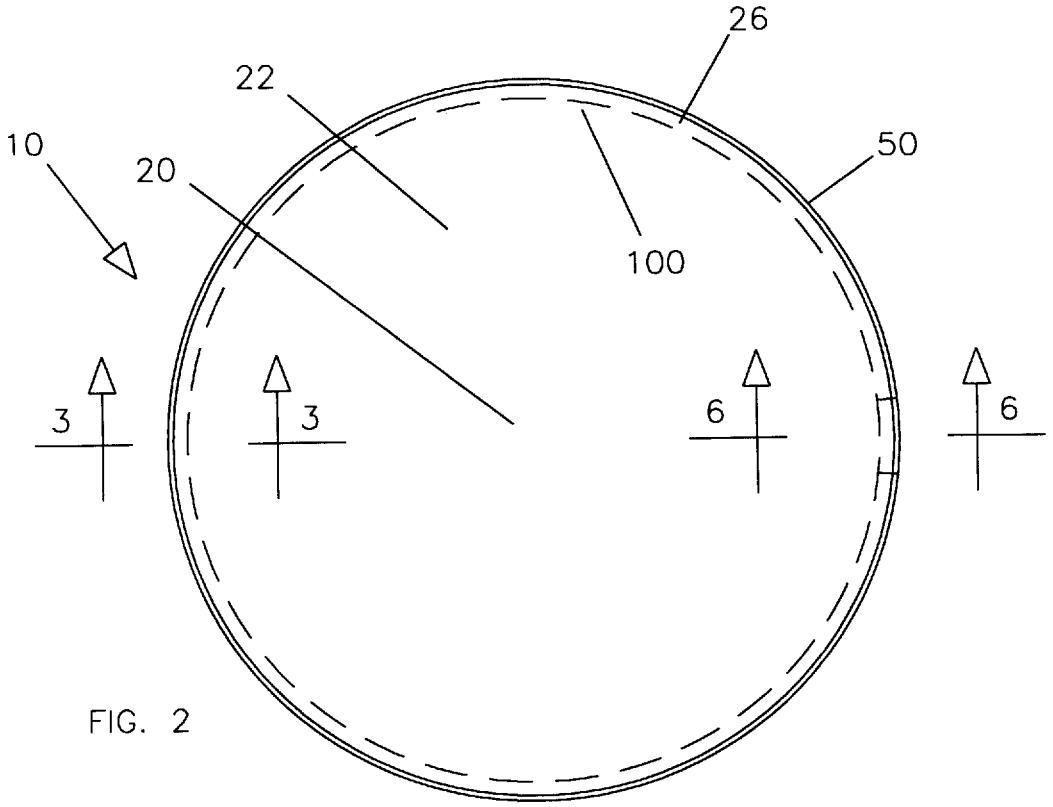
FIG. 2 is a top plan view of the coil cap of FIG. 1, also showing the aluminum coil in dotted outline.
Figure 5:
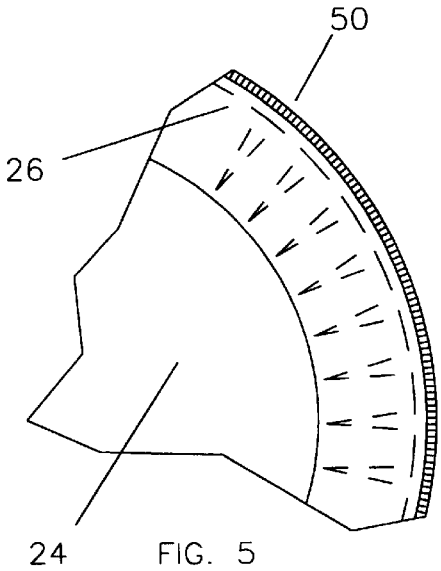
Figure 3:
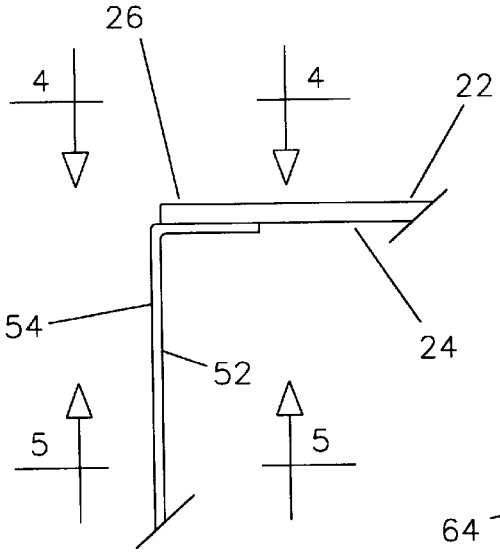
FIG. 3 is a somewhat diagrammatic view of the welded connection between the round fabric portion and the fabric skirt portion of the coil cap of FIG. 2, taken along the 3—3 lines.
Figure 6:
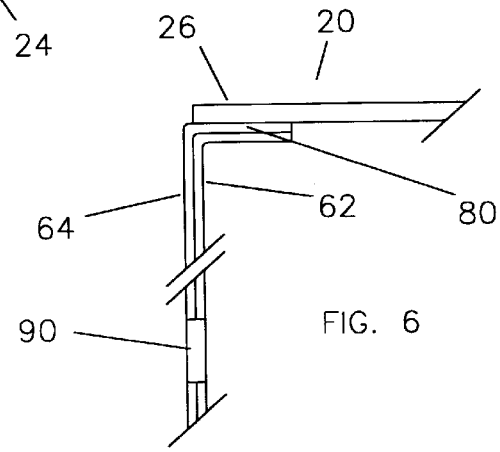

FIG. 5 is a somewhat diagrammatic bottom view of a portion of the welded connection between the round fabric portion and the fabric skirt portion of the coil cap of FIG. 3, taken along the 5—5 lines; and FIG. 6 is a somewhat diagrammatic view of the overlap weld connection between the round fabric portion and the upper edge of the first and second ends of the fabric skirt portion of the coil cap of FIGS. 1 and 2, taken along the 6—6 lines.

DESCRIPTION

Referring generally to FIGS. 1 through 6, a coil cap adapted to cover either end surface and a portion of an adjacent sidewall of the cylindrical body of coiled aluminum is seen. The coil cap 10, constructed in accordance with the principles of the invention, provides a round fabric portion 20 carrying a substantially rectangular fabric skirt portion 50. A welded region 70 connects a perimeter edge of the round fabric portion to an upper edge of the fabric skirt portion, creating the three-dimensional coil cap. An overlap weld 80 fastens together the upper edges of the opposed ends of the fabric skirt portion with a segment of the perimeter of the round fabric portion. A crimp weld 90 fastens a lower corner of each end of the skirt portion together, creating a three dimensional coil cap that is substantially in the form of a cylinder having a single closed end.

As seen in particular in FIGS. 1 and 2, the round fabric portion 20 protects the circular end surface 102 of a cylindrical aluminum coil 100 of rolled aluminum sheet.

In a preferred embodiment of the invention, the round fabric portion 20 is made of a woven coated polyethylene fabric having a thickness of approximately 12 mils. The fabric is typically woven from 1600 denier polyethylene tape. A coating of polyethylene having a thickness of 1.75 mils is carried on the upper and lower surfaces 22, 24. The coating of polyethylene functions primarily to allow the round fabric portion to be welded to the fabric skirt portion.

The diameter of the round fabric portion 20 is typically 10 to 90 inches, but is dependent on the size of the size of the coiled aluminum cylinder to be covered.

As seen particularly in FIG. 1, the fabric skirt portion 50 protects a portion of the sidewall 104 of the aluminum coil 100 adjacent to the end surface 102, and also functions to hold the round fabric portion 20 in place over the end surface.

In a preferred embodiment, the fabric skirt portion 50 is made of a woven coated polyethylene having a thickness of approximately 6 mils, and is woven from polyethylene tape. A coating of polyethylene having a thickness of approximately 1 mil is carried on the inner and outer surfaces 52, 54.

The height of the fabric skirt portion, from an upper edge 56 to a lower edge 58 is typically 17 inches, but may be a greater or lesser length. The length of the fabric skirt portion, between the first and second ends 62, 64, is typically approximately 12 inches longer than the circumference of the round fabric portion. The extra 12 inches in length provides for a region of overlap 60, where the first and second ends 62, 64 are adjacent.

The exact thicknesses of both the fabric skirt portion and the round fabric portion may be varied somewhat to conform to the needs of a specific application. However, it is a significant element of the invention that the round fabric portion 20 is typically approximately twice as thick as the fabric skirt portion 50. This ratio tends to afford greater protection to the end surface 102, while at the same time reducing the overall cost of the coil cap.

The thickness of the coating carried by the opposed sides of the round fabric portion and fabric skirt portion is not required to be the same. In some applications, and with some manufacturing procedures, a thicker coating on the sides to be welded together 22, 54 may be beneficial.

Figure 4:
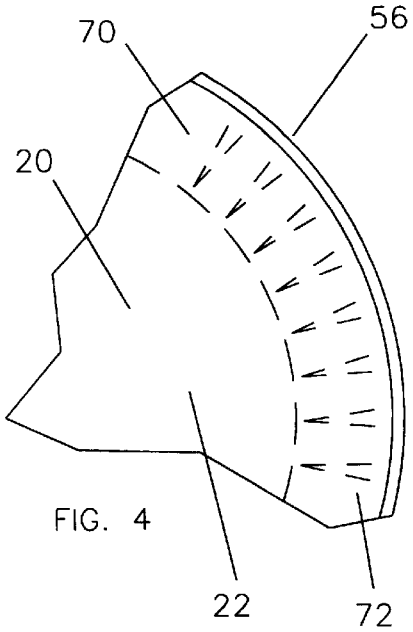
FIG. 4 is a somewhat diagrammatic top view of a portion of the welded connection between the round fabric portion and the fabric skirt portion of the coil cap of FIG. 3, taken along the 4—4 lines.

Referring particularly to FIGS. 3–5, a welded region 70 joins the upper edge 56 of the fabric skirt portion 50 to the perimeter edge 26 of the round fabric portion 20, thereby forming a three-dimensional coil cap. In a preferred embodiment of the invention, the welded region is approximately one inch in width.

As a result of the geometry of the three-dimensional interface between the rectangular skirt portion and the round fabric portion, the upper edge 56 of the fabric skirt portion 50 may form wrinkles 72, as seen in FIGS. 4 and 5. The wrinkles have no adverse effect on the quality or strength of the weld.

Referring to FIGS. 2 and 6, an overlap weld 80 joins the upper edge 56 of the fabric skirt adjacent to a first end 62 of the fabric skirt 50 to the upper edge of the fabric skirt adjacent to a second end 64 of the fabric skirt to a segment of the perimeter edge 26 of the round fabric portion 20. The overlap weld 80 therefore joins three layers of fabric. Since the length of the fabric skirt portion is typically 12 inches longer than the circumference of the round fabric portion, the length of the overlap weld 80 is typically 12 inches.

A crimp weld 90 joins a lower corner 66 of the first end 62 of the fabric skirt 50 to a lower corner of the second end 64 of the fabric skirt. The crimp weld tends to cause the fabric skirt portion to better grip the aluminum coil 100, by more closely wrapping about the sidewall 104. As seen in FIG. 1, the crimp Weld 90 is typically closer to the lower edge 58 than the upper edge 56, although the exact location is somewhat variable.

In the manufacturing process, an approximately 1 inch strip of the outer surface 54 adjacent to the upper edge 56 of the fabric skirt portion is hot air welded to an approximately 1 inch strip of the lower surface 24 adjacent to the outer perimeter edge 26 of the round fabric portion 20, forming the welded region 70. As a result of the curvature of the perimeter edge 26, a slight wrinkle 72 is formed in the upper edge 56 of the fabric skirt.

In a preferred method of performing the hot air welding process required to form the welded region 70, the skirt is on top and the round portion is on the bottom during the actual welding process. After the welding process is complete, the coil cap is turned right-side-out, i.e. the round fabric portion 20 is oriented on top, with the upper edge 56 of the skirt under the outer perimeter edge of the round fabric portion.

The crimp weld 90 is made in a known manner appropriate to the fabric being used for the fabric skirt.

The previously described versions of the present invention have many advantages, including a primary advantage of providing a novel coil cap having a heavier-weight round fabric portion welded to a lighter-weight fabric skirt portion, particularly where the use of hot glue is not possible with such fabrics. A related advantage is that while the fabrics used in the present invention cannot withstand hot glue, they are otherwise more durable that known fabrics adapted for use in coil cap construction, particularly in terms of abrasion and tearing resistance.

Another advantage of the present invention is to provide a novel coil cap having a welded region that is extremely durable, and which will not separate.

A still further advantage of the present invention is to provide a novel coil cap having a welded region that is three-dimensional in nature, and that allows some bunching, wrinkling or pleating of the upper edge of the fabric skirt portion within the welded region, while still providing a smooth, attractive and strong weld.

The invention resides not in any one of these features per se, but rather in the particular combination of all of them herein disclosed and claimed and it is distinguished from the prior art in this particular combination of all of its structures for the functions specified.

Although the present invention has been described in considerable detail and with reference to certain preferred versions, other versions are possible. For example, while specific fabric materials, dimensions and fabric thicknesses and fabric coating thicknesses have been disclosed, as required for the preferred embodiment, it is clear that some alteration of these dimensions could be made while still in keeping with the spirit and scope of the invention. Therefore, the spirit and scope of the appended claims should not be limited to the description of the preferred versions disclosed.

In compliance with the U.S. Patent Laws, the invention has been described in language more or less specific as to methodical features. The invention is not, however, limited to the specific features described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. A coil cap, adapted to cover an end surface and an adjacent portion of a sidewall of a cylindrical body, comprising:

(A) a round fabric portion made of woven coated polyethylene;

(B) a fabric skirt portion, made of woven coated polyethylene, wherein the thickness of the fabric skirt portion is approximately one-half the thickness of the round fabric portion;

(C) a welded region joining an upper edge of the fabric skirt portion to a perimeter edge of the round fabric portion, thereby forming a three-dimensional coil cap; and (D) an overlap weld joining the upper edge of the fabric skirt adjacent to a first end of the fabric skirt to the upper edge of the fabric skirt adjacent to a second end of the fabric skirt to a segment of the perimeter edge of the round fabric portion.

2. A coil cap, adapted to cover an end surface and an adjacent portion of a sidewall of a cylindrical body, comprising:

(A) a round fabric portion made of woven coated polyethylene having a thickness of approximately 12 mils and having a coating of polyethylene of 1.75 mils on each side;

(B) a substantially rectangular fabric skirt portion, made of woven coated polyethylene having a thickness of approximately 6 mils and having a coating of polyethylene having a thickness of approximately 1 mil on each side;

(C) a hot air welded region joining an upper edge of the fabric skirt portion to a perimeter edge of the round fabric portion, thereby forming a three-dimensional coil cap;

(D) a hot air overlap weld joining the upper edge of the fabric skirt adjacent to a first end of the fabric skirt to the upper edge of the fabric skirt adjacent to a second end of the fabric skirt to a segment of the perimeter edge of the round fabric portion; and (E) a crimp weld joining the first end of the fabric skirt to the second end of the fabric skirt.

* * * * *